US006049061A

United States Patent [19]

Gates et al.

[11] Patent Number: 6,049,061

[45] Date of Patent: Apr. 11, 2000

[54] HEATER FOR USE IN A MOBILE RADIO BASE STATION

[75] Inventors: William George Gates, Wolverton, United Kingdom; Martin Michael Mark Keegan, Greystones, Ireland

[73] Assignee: Lucent Technologies Inc., Murray Hill, N.J.

[21] Appl. No.: 09/175,177

[22] Filed: Oct. 20, 1998

[30] Foreign Application Priority Data

Oct. 21, 1997 [EP] European Pat. Off. ..... 97308340

[51] Int. Cl.[7] ..... H05B 1/00

[52] U.S. Cl. ..... 219/209; 219/464; 219/544; 396/575; 428/344

[58] Field of Search ..... 219/209, 211, 219/212, 219, 221, 400, 464, 520, 521, 526, 528, 529, 542, 549, 544, 216; 428/344, 354; 396/575

[56] References Cited

U.S. PATENT DOCUMENTS

| | | | |
|---|---|---|---|
| 3,662,150 | 5/1972 | Hartung | 219/209 |
| 3,810,304 | 5/1974 | Heibye et al. | 29/611 |
| 4,047,213 | 9/1977 | Land | 396/575 |
| 5,276,310 | 1/1994 | Schmidt et al. | 219/521 |
| 5,486,681 | 1/1996 | Dragnac et al. | 219/400 |
| 5,508,495 | 4/1996 | Yahav et al. | 219/464 |
| 5,624,750 | 4/1997 | Martinez et al. | 428/344 |

FOREIGN PATENT DOCUMENTS

| | | | |
|---|---|---|---|
| 0 295 351 A1 | 12/1988 | European Pat. Off. | H05B 3/36 |
| 2721788 | 12/1995 | France | H05B 3/28 |

*Primary Examiner*—Teresa Walberg
*Assistant Examiner*—L. Fastovsky
*Attorney, Agent, or Firm*—Patricia A. Verlangieri

[57] ABSTRACT

A heater comprising a heating element embedded in a dielectric sheet, is disclosed. A leaf spring which is curved when relaxed, clamps the embedded heating element against a surface to be heated. The heater is optionally mounted on an internal surface of an enclosure. The heater is operable to a flux of about 3.9 kW-m$^2$.

4 Claims, 1 Drawing Sheet

HEATER FOR USE IN A MOBILE RADIO BASE STATION

CROSS-REFERENCE TO RELATED APPLICATION

This application claims priority of European Patent Application No. 97308340.5, which was filed on Oct. 21, 1997.

1. Field of the Invention

This invention relates to heaters.

2. Description of the Related Art

The background of the present invention will be explained in relation to a particular application. The reader will appreciate, however, that the present invention is not limited to that application.

Externally mounted enclosures for mobile radio base stations potentially experience a wide range of ambient temperatures. If the internal temperature drops below about 0° C. the electronics cease to function. The external ambient temperature can fall to −45° C. At low external ambient temperatures, the heating which arises naturally from the electronics is insufficient to keep the internal temperature sufficiently high. Even at higher temperatures where the heat dissipation in the electronics is sufficient to keep the electronics operative, there can be a problem if a power cut occurs. If the internal temperature falls below that at which the electronics is operative, it will not restart when the power returns. A heater is therefore desired. In order to keep the enclosure desirably small the heater should not be large.

SUMMARY OF THE INVENTION

Against this background, in accordance with the invention there is provided a heater comprising: a foil heating element embedded in a dielectric sheet; and a leaf spring which is curved when relaxed for clamping the embedded element against a surface to be heated.

In the particular application described above, the heater can be mounted on an internal surface of the enclosure. Using a flexible heating element, the heater is typically operable to a flux of about 3.9 kW-m$^2$. The heater is mounted with a flexible dielectric face directly against an internal surface of the enclosure. No machining of the enclosure is needed since the flexible dielectric acts as a thermal gasket. In other conventional uses of such a heating element it is bonded to a surface with an adhesive such as double sided self adhesive tape.

In order to prevent local hot spots, the heater preferably includes a heat conductive layer which is mounted against a side of the embedded element, which in use is remote from the surface to be heated. To aid assembly, the heat conductive layer, which may be sheet aluminum, is bonded to the element with double sided adhesive tape.

Preferably, the embedded element is in the form of a conventional foil element laminated between two flexible dielectric layers.

In order to simplify assembly of the heater on the surface of the enclosure, it preferably includes fastening means including shoulder features which space ends of the spring from the surface to be heated by a distance approximately equal to the thickness of the embedded element and any conductive layer.

BRIEF DESCRIPTION OF THE DRAWING

One embodiment of the invention will now be described, by way of example, with reference to the accompanying drawings, in which.

DETAILED DESCRIPTION

Figure 1:
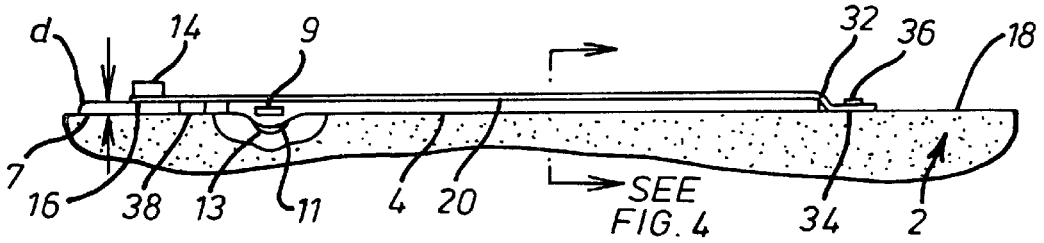
FIG. 1 is a side view of a heater embodying the present invention.

Referring to the drawings, an enclosure 2 (only part of which is shown) contains radio equipment (not shown) for a mobile telephone base station. The enclosure is formed from two interfitting light metal castings, part of one of which is shown in FIG. 1.

Figure 4:
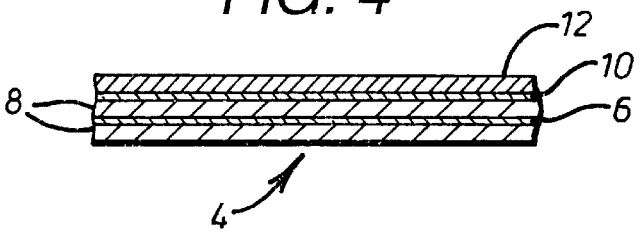
FIG. 4 is a detailed cross section of the heating element of the heater of FIG. 1.

A heating element 4 comprises a Nichrome foil resistor pattern 6, seen in cross-section in FIG. 4, sandwiched between two layers of flexible rubber dielectric 8. A thermal cutout 9 is located inside the heating element 4 and causes a bulge 11 in the lower layer 8 which projects from the heating element 4.

The element 4 is bonded by a layer of double sided adhesive tape 10, to an aluminum sheet 12 of similar dimension, which acts to disperse any potential hot spots in the assembled heater.

A fastener (e.g, two set screws), screwed into the enclosure, provide shoulders 16 spaced a distance, d, from the internal surface 18 of the enclosure 2. A leaf spring 20 is formed with notches 22 to receive the shanks (not shown) 24 of the set screws 14 so as to be retained by the heads 28. The heads 28 are positioned so that the underside 30 of the spring is spaced from the surface 18 of the enclosure 2 by a distance approximately equal to the combined thickness of the heating element and the sheet 12. The bulge 11 is received by a recess 13 in the surface 18 thereby locating the heating element 4.

Figure 2:
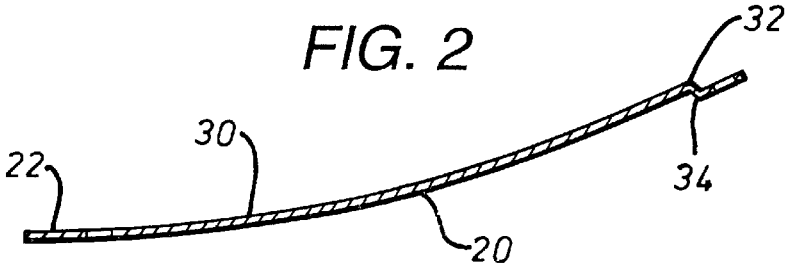
FIG. 2 is a cross-section of a spring, from the heater of FIG. 1, when relaxed.

As is shown in FIG. 2, the leaf spring 20 is curved when relaxed. At its end remote from the notches 22, the leaf spring 20 has a step providing a shoulder 32 leading to a tang 34. The step is approximately the size of the combined thickness of the heating element 4. When the tang 34 is fastened to the surface 18 of the enclosure 2 by a screw 36, the leaf spring clamps the heating element with a uniform load against the surface 18 of the enclosure 2. The provision of shoulders 16 and 32 ensure that the leaf spring 20 is not over tightened on the ends of the heating element 4.

Figure 3:
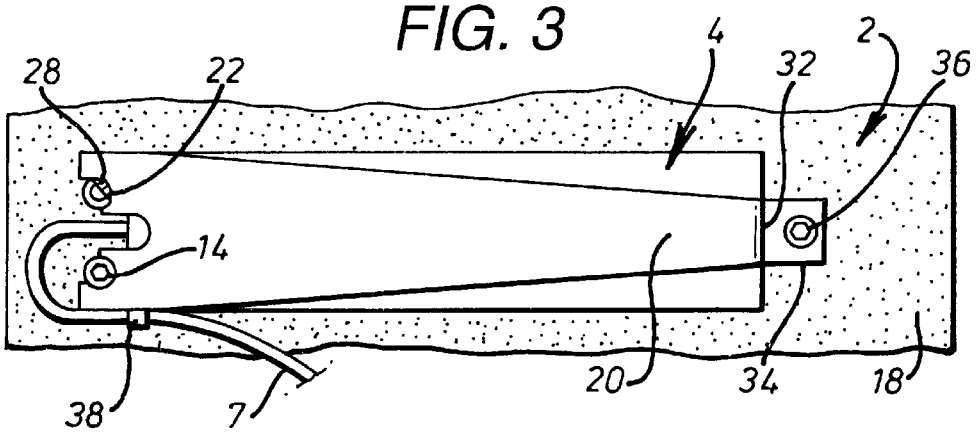
FIG. 3 is a plan view of the heater of FIG. 1.

As shown in FIG. 3, cable 7, clamped to enclosure 2 with integral corecive projection 38 couples the heating element 4 with a power supply (not shown). The heating element 4 is typically operable to a flux of about 3.9 kW-m$^2$.

The invention claimed is:

1. A heater, comprising:

a heating element embedded in a dielectric sheet;

a leaf spring, wherein the leaf spring is curved when relaxed for clamping the embedded heating element against a surface to be heated; and a fastener wherein the fastener includes shoulder features which space ends of the leaf spring from the surface to be heated by a distance equal to the thickness of the embedded heating element.

2. The heater of claim 1, further comprising a heat conductive layer attached against a side of the embedded heating element that is remote from the surface to be heated, wherein the heat conductive layer is attached against the side of the embedded heating element with an adhesive.

3. The heater of claim 1 wherein the heating element is a foil, wherein the dielectric sheet comprises two dielectric layers, and wherein the foil is laminated between the two dielectric layers.

4. The heater of claim 1 wherein the leaf spring includes an integral concave projection which serves as a cable clamp.

* * * * *